US007515865B2

(12) United States Patent
Matsushima et al.

(10) Patent No.: US 7,515,865 B2
(45) Date of Patent: Apr. 7, 2009

(54) RECORDING MEDIUM FEEDING DEVICE AND IMAGE FORMING APPARATUS

(75) Inventors: Ryoichi Matsushima, Nagoya (JP); Makoto Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 269 days.

(21) Appl. No.: 11/094,678

(22) Filed: Mar. 31, 2005

(65) Prior Publication Data

US 2005/0220517 A1 Oct. 6, 2005

(30) Foreign Application Priority Data

Mar. 31, 2004 (JP) ..... 2004-105504
Mar. 31, 2004 (JP) ..... 2004-107321
Aug. 10, 2004 (JP) ..... 2004-233684

(51) Int. Cl.
*B65H 5/06* (2006.01)
*B65H 5/00* (2006.01)

(52) U.S. Cl. ..... 399/381; 399/361; 399/388; 271/3.01; 271/3.08; 271/3.14; 271/8.1

(58) Field of Classification Search ..... 271/3.01, 271/3.08, 3.14, 8.1
See application file for complete search history.

(56) References Cited

U.S. PATENT DOCUMENTS 4,635,922 A 1/1987 Roetter et al.
5,344,134 A * 9/1994 Saeki et al. ..... 271/122
5,377,970 A 1/1995 Kikuchi
5,485,244 A * 1/1996 Gotoda et al. ..... 399/111
5,624,109 A * 4/1997 Tanaka ..... 271/10.13
6,015,148 A * 1/2000 Cho ..... 271/164
6,078,764 A 6/2000 Akutsu
6,311,026 B1 10/2001 Higeta et al.
6,385,414 B1 5/2002 Sato et al.
6,651,974 B2 * 11/2003 Kawarama et al. ..... 271/121
6,674,982 B2 1/2004 Saitoh et al.
6,739,778 B2 * 5/2004 Fuchi et al. ..... 400/693
6,994,341 B2 * 2/2006 Aoki et al. ..... 271/117
7,082,274 B2 7/2006 Saitoh et al.
2002/0050680 A1 5/2002 Yanagi et al.
2002/0096817 A1 7/2002 Miki
2003/0175042 A1 9/2003 Nishimura
2003/0185588 A1 10/2003 Takami et al.

FOREIGN PATENT DOCUMENTS

EP 1 201 576 A2 5/2002

(Continued)

*Primary Examiner*—Jill E. Culler
*Assistant Examiner*—'Wyn' Q Ha
(74) *Attorney, Agent, or Firm*—Oliff & Berridge, PLC

(57) ABSTRACT

A recording medium feeding device includes: a delivery roller provided so as to abut on a surface of recording media and for delivering the recording media to a downstream side in a direction of conveyance of the recording media in accordance with the rotation of the delivery roller; a separation member provided on the downstream side with respect of the delivery roller; and a feed roller provided opposite to the separation member to sandwich the recording media delivered by the delivery roller with the separation member, the feed roller rotating for separating and conveying the recording media one by one, wherein a diameter of the feed roller is larger than a diameter of the delivery roller.

24 Claims, 8 Drawing Sheets

FOREIGN PATENT DOCUMENTS

| | | | | |
|---|---|---|---|---|
| EP | 1 220 047 | A2 | | 7/2002 |
| JP | U 54-153684 | | | 10/1979 |
| JP | A-59-045466 | | | 3/1984 |
| JP | U-59-173638 | | | 11/1984 |
| JP | 63037042 | A | * | 2/1988 |
| JP | A-63-37044 | | | 2/1988 |
| JP | 63-37643 | | | 3/1988 |
| JP | A-2-48974 | | | 2/1990 |
| JP | 04333435 | A | * | 11/1992 |
| JP | A-04-329557 | | | 11/1992 |
| JP | A 5-4397 | | | 1/1993 |
| JP | A-05-297649 | | | 11/1993 |
| JP | 06001475 | A | * | 1/1994 |
| JP | A-06-106819 | | | 4/1994 |
| JP | A-06-308793 | | | 11/1994 |
| JP | A 6-321367 | | | 11/1994 |
| JP | A 7-76430 | | | 3/1995 |
| JP | U 7-30240 | | | 6/1995 |
| JP | A-7-215497 | | | 8/1995 |
| JP | A-07-244410 | | | 9/1995 |
| JP | A-7-304527 | | | 11/1995 |
| JP | A 8-30180 | | | 2/1996 |
| JP | B2 8-13565 | | | 2/1996 |
| JP | A-8-169575 | | | 7/1996 |
| JP | A-09-185201 | | | 7/1997 |
| JP | A 9-185202 | | | 7/1997 |
| JP | A 10-116014 | | | 5/1998 |
| JP | A-10-254327 | | | 9/1998 |
| JP | A 11-155034 | | | 6/1999 |
| JP | B2 2938555 | | | 6/1999 |
| JP | A 11-202734 | | | 7/1999 |
| JP | B2 2951712 | | | 7/1999 |
| JP | A 2000-147960 | | | 5/2000 |
| JP | A 2000-347472 | | | 12/2000 |
| JP | A-2001-042586 | | | 2/2001 |
| JP | 2001-100550 | A | | 4/2001 |
| JP | A 2001-100493 | | | 4/2001 |
| JP | A-2001-175123 | | | 6/2001 |
| JP | 2001233473 | A | * | 8/2001 |
| JP | A 11-282075 | | | 10/2001 |
| JP | A-2002-062711 | | | 2/2002 |
| JP | 2002068554 | A | * | 3/2002 |
| JP | A-2002-87627 | | | 3/2002 |
| JP | A-2002-108170 | | | 4/2002 |
| JP | 2002-162865 | A | | 6/2002 |
| JP | A 2003-76249 | | | 3/2003 |
| JP | A 2003-271030 | | | 9/2003 |
| JP | A 2003-295720 | | | 10/2003 |

* cited by examiner

RECORDING MEDIUM FEEDING DEVICE AND IMAGE FORMING APPARATUS

BACKGROUND OF THE INVENTION

1. Field of the Invention

The present invention relates to a recording medium feeding device for separating and conveying sheets of a recording medium one by one, and an image forming apparatus provided with the same.

2. Description of the Related Art

There has been heretofore a paper feeding mechanism in which stacked sheets of paper are fed by a pickup roller rotating while abutting on a surface of the stacked sheets of paper and in which the fed sheets of paper are one-by-one delivered by a separation roller rotating while holding the sheets of paper between the separation roller and a friction pad (see Japanese Patent Publication No. 013565/1996).

SUMMARY OF THE INVENTION

When paper separability is taken into account, it is preferable that the diameter of the separation roller is taken large to increase the area of contact between the separation roller and the sheets of paper. On the other hand, if reduction in size of the device is taken into account, it is preferable that the diameter of each roller is taken small. In the paper feeding mechanism according to the background art, however, the pickup roller and the separation roller are formed to have the same diameter. There is no consideration about the intention of attaining improvement in separability while attaining reduction in size of the device.

The present invention is accomplished based on the aforementioned circumstances and has as its object the provision of a recording medium feeding device and an image forming apparatus in which improvement in separability can be attained while reduction in size of the device can be attained.

According to a first aspect of the invention, there is provided a recording medium feeding device including: a delivery roller provided so as to abut on a surface of recording media and for delivering the recording media to a downstream side in a direction of conveyance of the recording media in accordance with the rotation of the delivery roller; a separation member provided on the downstream side with respect of the delivery roller; and a feed roller provided opposite to the separation member to sandwich the recording media delivered by the delivery roller with the separation member, the feed roller rotating for separating and conveying the recording media one by one, wherein a diameter of the feed roller is larger than a diameter of the delivery roller.

According to a second aspect of the invention, there is provided an image forming apparatus including: a delivery roller provided so as to abut on a surface of recording media and for delivering the recording media to a downstream side in a direction of conveyance of the recording media in accordance with the rotation of the delivery roller; a separation member provided on the downstream side with respect of the delivery roller; a feed roller provided opposite to the separation member to sandwich the recording media delivered by the delivery roller with the separation member, the feed roller rotating for separating and conveying the recording media one by one; and an image forming section that forms an image on the recording media conveyed by the feed roller, wherein a diameter of the feed roller is larger than a diameter of the delivery roller.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

An embodiment of the invention will be described below with reference to FIGS. 1-8C.

1. Configuration of the Embodiment

Figure 1:
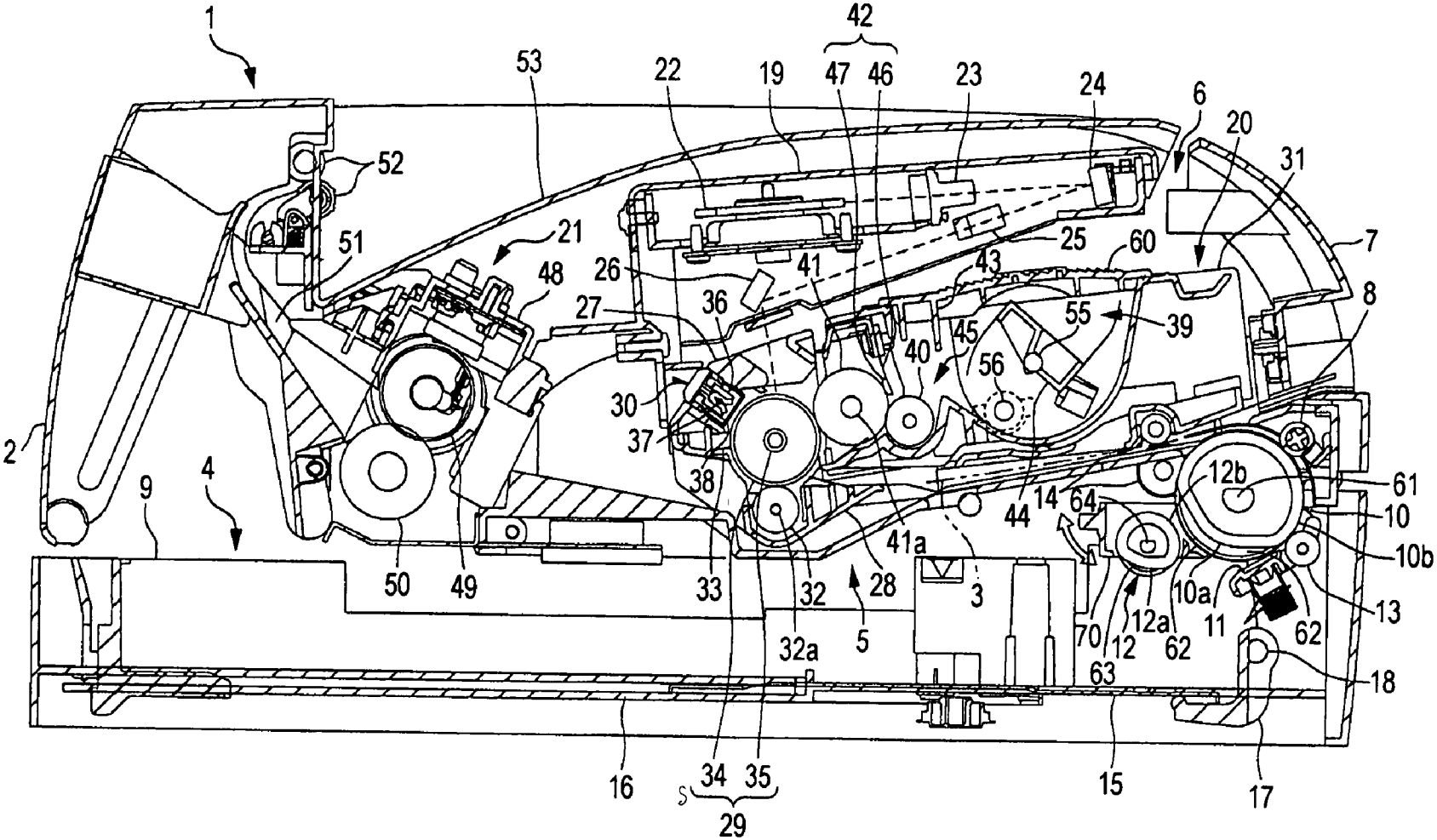
FIG. 1 is a side sectional view of essential part showing a laser printer according to an embodiment of the invention.

FIG. 1 is a side sectional view of essential part showing a laser printer as an image forming apparatus according to the invention. The laser printer 1 includes a body casing 2, a feeder portion 4 (equivalent to a "recording medium feeding device" in this invention) for feeding a sheet of paper 3 as a recording medium, and an image-forming portion 5 for forming an image on the fed sheet of paper 3. The feeder portion 4 and the image-forming portion 5 are stored in the body casing 2.

(1) Body Casing

An attachment/detachment hole 6 for attaching/detaching a process cartridge 20 which will be described later is formed in a side wall of the body casing 2. A front cover 7 is provided for opening/closing the attachment/detachment hole 6. The front cover 7 is pivotally supported by a cover shaft (not shown) inserted in a lower end portion of the front cover 7. Accordingly, when the front cover 7 is closed with the cover shaft as its center, the attachment/detachment hole 6 is blocked with the front cover 7 as shown in FIG. 1. When the front cover 7 is opened with the cover shaft as a fulcrum (i.e. the front cover 7 is pulled out), the attachment/detachment hole 6 is released so that the process cartridge 20 can be attached/detached to/from the body casing 2 through the attachment/detachment hole 6.

Incidentally, in the following description, in the laser printer 1 and the process cartridge 20 which will be described later, a side on which the front cover 7 is provided in a state in which the process cartridge 20 is mounted in the body casing 2 is regarded as "front side" whereas a side opposite to the front side is regarded as "rear side".

(2) Feeder Portion

The feeder portion 4 includes: a paper supply tray 9 (equivalent to a "recording medium storage portion" in this invention) detachably attached to a bottom portion in the body casing 2; a paper supply roller 10 (equivalent to a "feed roller" in this invention) and a separation pad 11 (equivalent to a "separation member" in this invention) provided above a front end portion of the paper supply tray 9; a pickup roller 12 (equivalent to a "delivery roller" in this invention) provided in the rear of the paper supply roller 10; a pinch roller 13 disposed on a frontal downside of the paper supply roller 10 so as to be opposite to the paper supply roller 10; a paper dust removal roller 8 disposed on a frontal upside of the paper supply roller 10 so as to be opposite to the paper supply roller 10; and registration rollers 14 (equivalent to a "conveyance member" in this invention) provided on a rear upside of the paper supply roller 10.

A paper pressing plate 15 (equivalent to a "loading portion" in this invention) is provided in the inside of the paper supply tray 9 so that sheets of paper 3 can be stacked stratiformly. The paper pressing plate 15 is pivotally supported at its rear end portion so that the paper pressing plate 15 can be rotated to a loading position where its front end portion is disposed downward along a bottom plate 16 of the paper supply tray 9 and a conveyance position where its front end portion is disposed upward and inclined.

A lever 17 (equivalent to a "moving mechanism" in this invention) for lifting up the front end portion of the paper pressing plate 15 is provided in the front end portion of the paper supply tray 9. The lever 17 is substantially shaped like an "L" figure in sectional view so that the lever 17 extends downward from the front side of the paper pressing plate 15. An upper end portion of the lever 17 is attached to a lever shaft 18 provided in the front end portion of the paper supply tray 9. A rear end portion of the lever 17 abuts on the front end portion of the lower surface of the paper pressing plate 15. Accordingly, when driving force for clockwise rotation in FIG. 1 is given to the lever shaft 18, the lever 17 rotates with the lever shaft 18 as a fulcrum to make the rear end portion of the lever 17 lift up the front end portion of the paper pressing plate 15 to thereby locate the paper pressing plate 15 in the conveyance position. Incidentally, an elevator mechanism for lifting up the paper pressing plate 15 will be described later in detail.

When the paper pressing plate 15 is located in the conveyance position, sheets of paper 3 on the paper pressing plate 15 are pressed by the pickup roller 12 and begin to be conveyed toward a position (hereinafter referred to as "separation position X" and equivalent to a "position where the feed roller and the separation member are opposite to each other" in this invention) between the paper supply roller 10 and the separation pad 11.

On the other hand, when the paper supply tray 9 is detached from the body casing 2, the front end portion of the paper pressing plate 15 is moved down by its own weight so that the paper pressing plate 15 is located in the loading position. When the paper pressing plate 15 is located in the loading position, sheets of paper 3 can be stacked stratiformly on the paper pressing plate 15.

The sheets of paper 3 delivered toward the separation position X by the pickup roller 12 are fed while treated one by one surely when clamped between the paper supply roller 10 and the separation pad 11. The fed sheet of paper 3 is turned back like a "U" figure along the circumferential surface of the paper supply roller 10. More specifically, the fed sheet of paper 3 is first conveyed upward through between the paper supply roller 10 and the pinch roller 13. After the fed sheet of paper 3 then passes through between the paper supply roller 10 and the paper dust removal roller 8 so that paper dust is removed, the fed sheet of paper 3 is conveyed to the registration rollers 14. Incidentally, the feeding direction of the sheet of paper 3 is equivalent to a "direction of conveyance of the recording medium" in this invention.

The registration rollers 14 are formed as a pair of rollers. After registration of the sheet of paper 3, the registration rollers 14 convey the sheet of paper 3 to a position between a photosensitive drum 29 and a transfer roller 32 (which will be described later), that is, to a transfer position where a toner image on a photosensitive drum 29 will be transferred onto the sheet of paper 3.

(3) Image-Forming Portion

The image-forming portion 5 includes a scanner portion 19, a process cartridge 20, and a fixing portion 21.

(a) Scanner Portion

The scanner portion 19 is provided in an upper portion in the body casing 2. The scanner portion 19 has a laser light source not shown, a polygon mirror 22 driven to rotate, an fθ lens 23, a reflection mirror 24, a lens 25, a reflection mirror 26, and so on. A laser beam emitted from the laser light source on the basis of image data is deflected by the polygon mirror 22 as represented by the chain line in FIG. 1. After the laser beam passes through the fθ lens 23, an optical path is turned back by the reflection mirror 24. After the laser beam further passes through the lens 25, the optical path is bent down by the reflection mirror 26. In this manner, the laser beam is applied onto a surface of the photosensitive drum 29 (which will be described later) of the process cartridge 20.

(b) Process Cartridge

The process cartridge 20 is disposed below the scanner portion 19 and formed so as to be detachably attached to the body casing 2. The process cartridge 20 has an upper frame 27 and a lower frame 28 which serve as a casing. The lower frame 28 is formed separately from the upper frame 27 and combined with the upper frame 27. The process cartridge 20 has a photosensitive drum 29 as an image carrier, a scorotron type charger 30 as a charging means, a developing cartridge 31, a transfer roller 32 as a transfer means, and a cleaning brush 33. These members 29 to 33 are provided in the casing.

The photosensitive drum 29 has a drum body 34, and a drum shaft 35. The drum body 34 is shaped like a cylinder and has an outermost layer constituted by a positively chargeable photosensitive layer made of polycarbonate or the like. The drum shaft 35 is made of metal and serves as a shaft extending on the core of the drum body 34 along the lengthwise direction of the drum body 34. The drum shaft 35 is supported by the upper frame 27. The drum body 34 is supported so as to be rotatable on the drum shaft 35. In this manner, the photosensitive drum 29 is provided in the upper frame 27 so as to be rotatable on the drum shaft 35.

The scorotron type charger 30 is supported by the upper frame 27 and disposed obliquely above the rear of the photosensitive drum 29 and at a predetermined distance from the photosensitive drum 29 so as to be opposite to the photosensitive drum 29 and prevented from coming into contact with the photosensitive drum 29. The scorotron type charger 30 has a discharge wire 37, and a grid 38. The discharge wire 37 is disposed at a predetermined distance from the photosensitive drum 29 so as to be opposite to the photosensitive drum 29. The grid 38 is provided between the discharge wire 37 and the photosensitive drum 29 for controlling the quantity of electric discharge from the discharge wire 37 to the photosensitive drum 29. In the scorotron type charger 30, when a bias voltage is applied to the grid 38 while a high voltage is applied to the discharge wire 37 to thereby make the discharge wire 37 perform corona discharge, the surface of the photosensitive drum 29 can be evenly charged with positive electricity.

Incidentally, a cleaning member 36 for cleaning the discharge wire 37 is provided in the scorotron type charger 30 so that the discharge wire 37 is clamped by the cleaning member 36.

The developing cartridge 31 has a box-like casing 60 opened on its rear side. The developing cartridge 31 is detachably attached to the lower frame 28. A toner storage chamber 39, a toner supply roller 40 (different from the "feed roller" in this invention), a developing roller 41 and a layer thickness limiting blade 42 are provided in the developing cartridge 31.

The toner storage chamber 39 is formed as an inner space which is provided as a front portion of the casing 60 by partitioning the casing 60 by a partition plate 43. The toner storage chamber 39 is filled with positively chargeable non-magnetic one-component toner as an example of the developing agent. For example, the toner used is polymerized monomer such as polymer toner prepared by copolymerizing styrene monomers such as styrene, etc. or acrylic monomers such as acrylic acid, alkyl(C1-C4) acrylate, alkyl(C1-C4) methacrylate, etc. by means of suspension polymerization or the like. Particles of the polymer toner are substantially spherical and have very good fluidity, so that formation of a high-quality image can be achieved.

Incidentally, a coloring agent such as carbon black, etc., wax, and so on may be mixed with the toner. External additives such as silica, etc. may be added to the toner in order to improve the fluidity. The mean particle size of the toner is in a range of from about 6 to 10 μm.

An agitator 44 is provided in the toner storage chamber 39 so as to be supported by a rotation shaft 55 provided in the center of the toner storage chamber 39. The agitator 44 is driven to rotate by motive power given from a motor not shown. When the agitator 44 is driven to rotate, the toner in the toner storage chamber 39 is agitated and released from an opening portion 45 toward the toner supply roller 40. The opening portion 45 is provided under the partition plate 43 so as to connect front and rear spaces to each other. Window members 56 are attached to left and right side walls of the casing 60 respectively so as to be located in a region corresponding to the toner storage chamber 39. Each window member 56 is cleaned with a wiper which is held by the agitator 44 so as to cooperate with the agitator 44. Incidentally, in the body casing 2, a light-emitting element (not shown) is provided on the outside of one window member 56 and a photo acceptance element (not shown) is provided on the outside of the other window member 56. Detection light emitted from the light-emitting element and passing through the inside of the casing 60 is detected by the photo acceptance element. A judgment is made in accordance with the output value of the detection light as to whether the toner remains or not.

The toner supply roller 40 is disposed in the rear side of the opening portion 45 and supported by the developing cartridge 31 so as to be rotatable. The toner supply roller 40 has a roller shaft made of metal, and a roller made of an electrically conductive foaming agent. The roller shaft is covered with the roller. The toner supply roller 40 is driven to rotate by motive power given from a motor not shown.

The developing roller 41 is rotatably supported by the developing cartridge 31 in the condition that the developing roller 41 and the toner supply roller 40 are brought into contact with each other in the rear side of the toner supply roller 40 so as to be compressed. The developing roller 41 is brought into contact with the photosensitive drum 29 so as to be opposite to the photosensitive drum 29 in the condition that the developing cartridge 31 is attached to the lower frame 28. The developing roller 41 has a roller shaft 41*a* made of metal, and a roller made of an electrically conductive rubber material. The roller shaft 41*a* is covered with the roller. In the front end portion of the developing cartridge 31, opposite end portions of the roller shaft 41*a* protrude outward from sides of the developing cartridge 31 in a widthwise direction perpendicular to a front-rear direction. The roller of the developing roller 41 has a roller body made of electrically conductive urethane rubber or silicone rubber containing carbon fine particles, and a coat layer made of urethane rubber or silicone rubber containing fluorine. The roller body is covered with the coat layer. At the time of development, a developing bias is applied to the developing roller 41. The developing roller 41 is driven to rotate in the same direction as the direction of rotation of the toner supply roller 40 by motive power given from a motor not shown.

The layer thickness limiting blade 42 has a blade body 46 made of a metal plate spring material, and a pressing portion 47 made of electrically insulating silicone rubber. The pressing portion 47 is provided at a front end portion of the blade body 46 and shaped like a semi-circle in sectional view. The layer thickness limiting blade 42 is disposed on the developing roller 41 so as to be supported by the developing cartridge 31. The pressing portion 47 is brought into forced contact with the developing roller 41 by elastic force of the blade body 46.

The toner released from the opening portion 45 is supplied to the developing roller 41 in accordance with the rotation of the toner supply roller 40. On this occasion, the toner is charged with positive electricity based on friction between the toner supply roller 40 and the developing roller 41. The toner supplied onto the developing roller 41 passes through between the pressing portion 47 of the layer thickness limiting blade 42 and the developing roller 41 in accordance with rotation of the developing roller 41, so that the toner is carried as a thin layer having a predetermined thickness on the developing roller 41.

The transfer roller 32 is supported by the lower frame 28 so as to be rotatable. The transfer roller 32 is disposed so that the transfer roller 32 is brought into contact with the photosensitive drum 29 in the vertical direction to thereby form a nip between the transfer roller 32 and the photosensitive drum 29 in the condition that the upper frame 27 and the lower frame 28 are combined with each other. The transfer roller 32 has a roller shaft 32*a* made of metal, and a roller made of an electrically conductive rubber material. The roller shaft 32*a* is covered with the roller. At the time of transfer, a transfer bias is applied to the transfer roller 32. The transfer roller 32 is driven to rotate in a direction reverse to the direction of rotation of the photosensitive drum 29 by motive power given from a motor not shown.

The cleaning brush 33 is attached to the lower frame 28. The cleaning brush 33 is disposed so that the cleaning brush 33 and the photosensitive drum 29 are brought into contact with each other in the rear side of the photosensitive drum 29 so as to be opposite to each other in the condition that the upper frame 27 and the lower frame 28 are combined with each other.

With the rotation of the photosensitive drum 29, first, the surface of the photosensitive drum 29 is evenly charged with positive electricity by the scorotron type charger 30. Then, the surface of the photosensitive drum 29 is exposed to the laser beam emitted from the scanner portion 19 by means of highspeed scanning of the laser beam. In this manner, an electrostatic latent image corresponding to the image to be formed on the sheet of paper 3 is formed.

Then, when the toner carried on the developing roller 41 and charged with positive electricity is brought into contact with the photosensitive drum 29 so as to be opposite to the photosensitive drum 29 in accordance with the rotation of the developing roller 41, the toner is supplied to the electrostatic latent image formed on the surface of the photosensitive drum 29, that is, on an exposure portion which is part of the surface of the photosensitive drum 29 evenly charged with positive electricity and which is exposed to the laser beam so that electric potential is lowered. In this manner, the electrostatic latent image on the photosensitive drum 29 is visualized so that a toner image based on reversal development is carried on the surface of the photosensitive drum 29.

As shown in FIG. 1, the toner image carried on the surface of the photosensitive drum 29 is then transferred onto the sheet of paper 3 by the transfer bias applied to the transfer roller 32 when the sheet of paper 3 conveyed by the registration rollers 14 passes through the transfer position between the photosensitive drum 29 and the transfer roller 32. The sheet of paper 3 onto which the toner image is transferred is conveyed to the fixing portion 21.

Incidentally, after transfer, the residual toner remaining on the photosensitive drum 29 is collected by the developing roller 41. In addition, after transfer, paper dust derived from the sheet of paper 3 and deposited on the photosensitive drum 29 is collected by the cleaning brush 33.

(c) Fixing Portion

The fixing portion 21 is provided on the rear side of the process cartridge 20. The fixing portion 21 has a fixing frame 48, a heat roller 49, and a pressure roller 50. The heat roller 49 and the pressure roller 50 are provided in the fixing frame 48.

The heat roller 49 has a metal tube, and a halogen lamp for heating the toner. The metal tube has a surface coated with a fluororesin. The halogen lamp is provided in the metal tube. The heat roller 49 is driven to rotate by motive power given from a motor not shown. On the other hand, the pressure roller 50 is disposed under the heat roller 49 so as to be opposite to the heat roller 49 to press the heat roller 49. The pressure roller 50 has a roller shaft made of metal, and a roller made of a rubber material. The roller shaft is covered with the roller. The pressure roller 50 is rotated following the rotation of the heat roller 49.

In the fixing portion 21, the toner transferred onto the sheet of paper 3 in the transfer position is thermally fixed when the sheet of paper 3 passes through between the heat roller 49 and the pressure roller 50. The sheet of paper 3 having the toner fixed is conveyed to a paper ejection path 51 extending vertically toward the upper surface of the body casing 2. The sheet of paper 3 conveyed to the paper ejection path 51 is ejected onto a paper ejection tray 53 formed on the upper surface of the body casing 2, by a paper ejection roller 52 provided on the upper side of the paper-ejection path 51.

2. Configuration of Pickup Roller and Paper Supply Roller

In this embodiment, the paper supply roller 10 is provided as a non-circular roller in sectional view. More specifically, the sectional shape of the paper supply roller 10 perpendicular to a rotation shaft 61 is so non-circular that the diameter of a circular arc portion about one third the sectional shape is continuously smaller than the remaining circular arc portion two thirds the sectional shape as shown in FIG. 1. Hereinafter, the portion having a reduced diameter is referred to as "small diameter portion 10*a*" whereas the portion having a diameter larger than that of the small diameter portion is referred to as "large diameter portion 10*b*".

Figure 2:
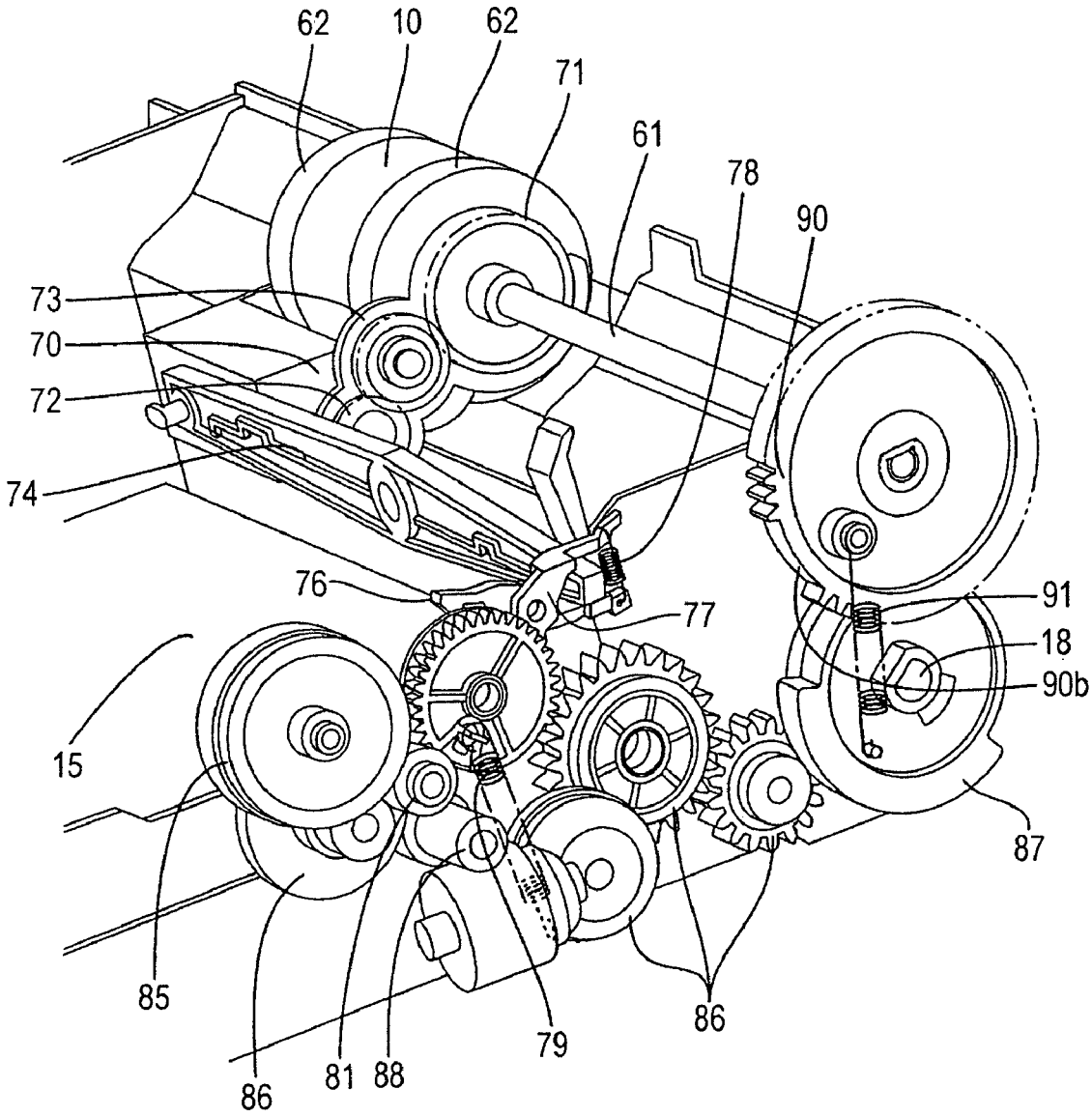
FIG. 2 is a perspective view showing an elevating mechanism portion of a paper pressing plate.

As shown in FIG. 2 (in which the feeding portion of the sheet of paper 3 is a direction toward the upper right), a pair of collar members 62 and 62 (equivalent to "parting member" or "disk members" in this invention) each shaped like a circular flat plate are provided at opposite ends of the paper supply roller 10 so as to be rotatable on the rotation shaft 61. Accordingly, the paper supply roller 10 rotates and stops integrally with the rotation shaft 61 but the pair of collar members 62 and 62 idle independent of the rotation shaft 61. The diameter of each collar member 62 is larger than the diameter of the small diameter portion 10*a* of the paper supply roller 10 and smaller than the diameter of the large diameter portion 10*b*.

On the other hand, the pickup roller 12 is provided as a non-circular roller in sectional view in the same manner as the paper supply roller 10 except that the diameter of the pickup roller 12 is half the diameter of the paper supply roller 10 in terms of shape. Hereinafter, the reduced-diameter portion of the pickup roller 12 is referred to as "small diameter portion 12*a*" whereas the portion having a diameter larger than the small diameter portion is referred to as "large diameter portion 12*b*". A pair of collar members 63 and 63 (equivalent to "parting member" or "disk members" in this invention) each shaped like a circular flat plate are provided in the pickup roller 12 so as to be rotatable on a rotational shaft 64. Accordingly, the pickup roller 12 rotates and stops integrally with the rotation shaft 64 but the pair of collar members 63 and 63 idle independent of the rotation shaft 64. The diameter of each collar member 63 is larger than the diameter of the small diameter portion 12*a* of the pickup roller 12 and smaller than the diameter of the large diameter portion 12*b*.

The pickup roller 12 and the paper supply roller 10 are rotatably supported by bearing members 70 equivalent to "connection members" in this invention. As shown in FIG. 2, gears 71 and 72 rotating integrally with the rotation shafts 61 and 64 respectively are provided coaxially with the pickup roller 12 and the paper supply roller 10 respectively. The two rollers 10 and 12 rotate interlockingly through a connection gear 73 which engages with the gears 71 and 72. In this embodiment, as will be described later, the number of teeth of each gear and the diameter of each gear are adjusted so that the pickup roller 12 is driven to make two rotations when the paper supply roller 10 makes one rotation on the basis of driving force received from a drive motor.

The bearing members 70 are formed so that the pickup roller 12 side pivots on the rotation shaft 61 of the paper supply roller 10 (in the direction of the white arrow in FIG. 1). As will be described later, when the paper pressing plate 15 is driven to move up, the surface of the uppermost one of the sheets of paper 3 stacked on the paper pressing plate 15 comes into contact with the pickup roller 12 from below so that the pickup roller 12 moves up.

3. Mechanism for Moving Up the Paper Pressing Plate (Moving Mechanism)

(1) Configuration of the Mechanism for Moving Up the Paper Pressing Plate

As described above, the paper pressing plate 15 is lifted, by the lever 17, up to the conveyance position where the surface of the uppermost one of the sheets of paper 3 stacked on the paper pressing plate 15 abuts on the pickup roller 12. When a predetermined number of sheets of paper 3 (e.g. ten sheets of paper in this embodiment) are supplied, the paper pressing plate 15 is further lifted again up to the conveyance position where the surface of the uppermost one of the remaining sheets of paper 3 abuts on the pickup roller 12.

Figure 3A:
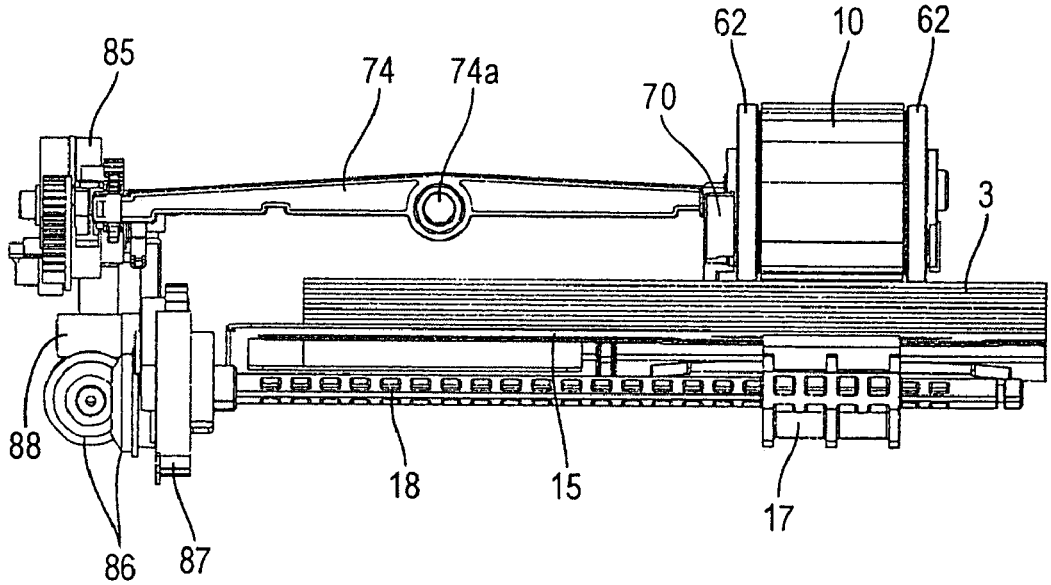
FIGS. 3A and 3B are front views of the elevating mechanism portion of the paper pressing plate.
Figure 3B:
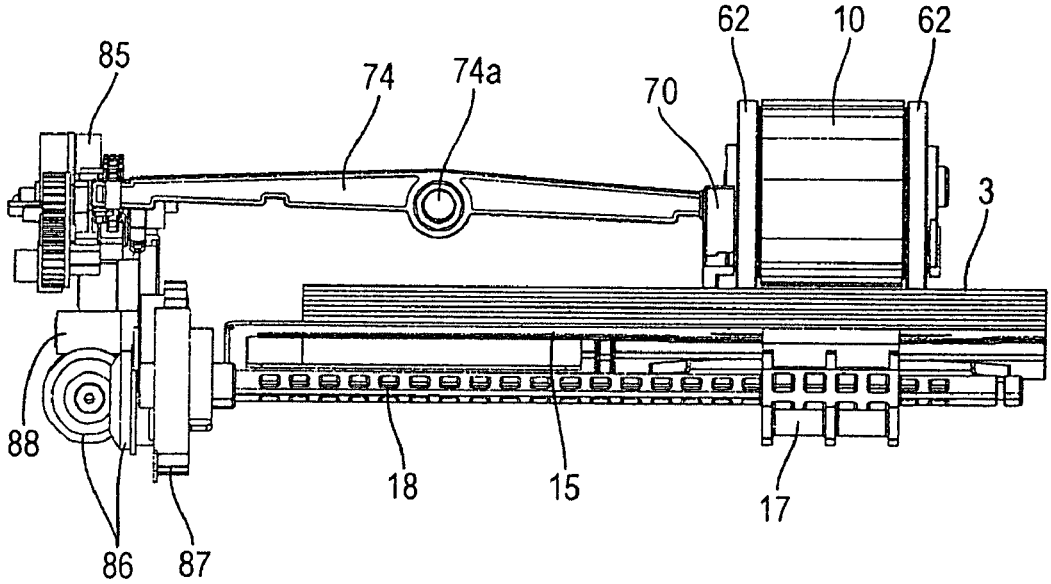
Figure 4A:
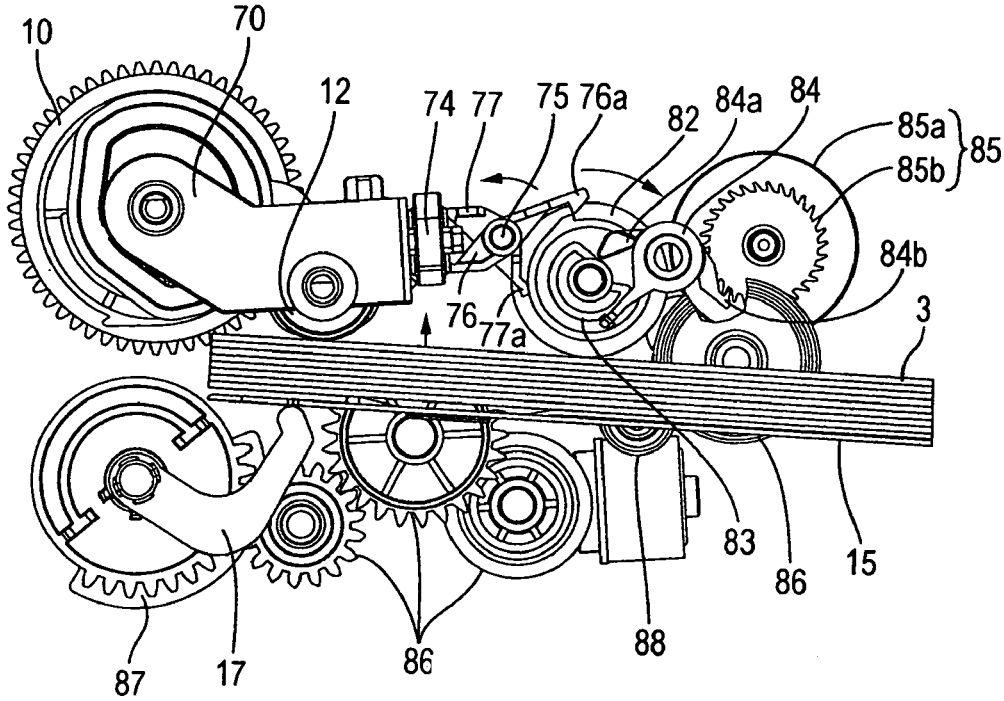
FIGS. 4A and 4B are right views of the elevating mechanism portion of the paper pressing plate (viewed from the side reverse to FIG. 1)
Figure 4B:
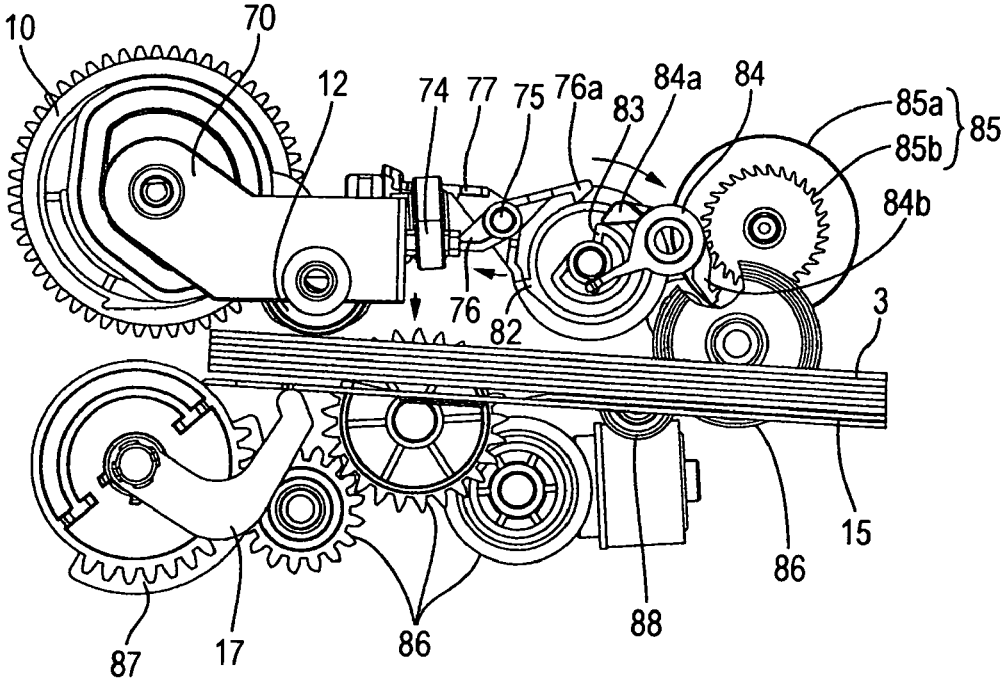
Figure 5A:
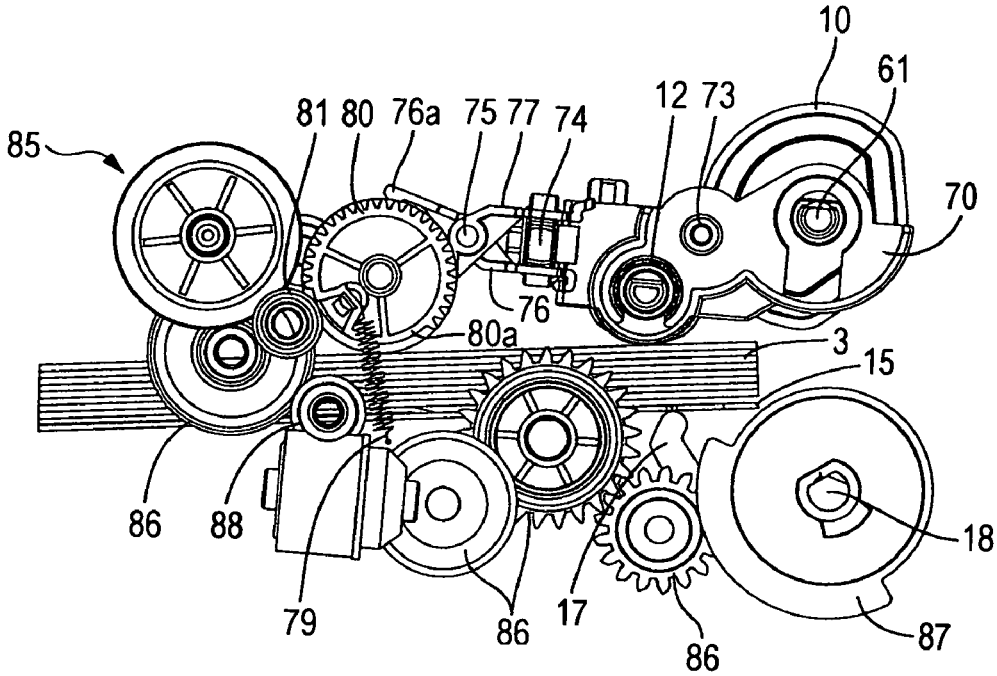
FIGS. 5A and 5B are left views of the elevating mechanism portion of the paper pressing plate.
Figure 5B:
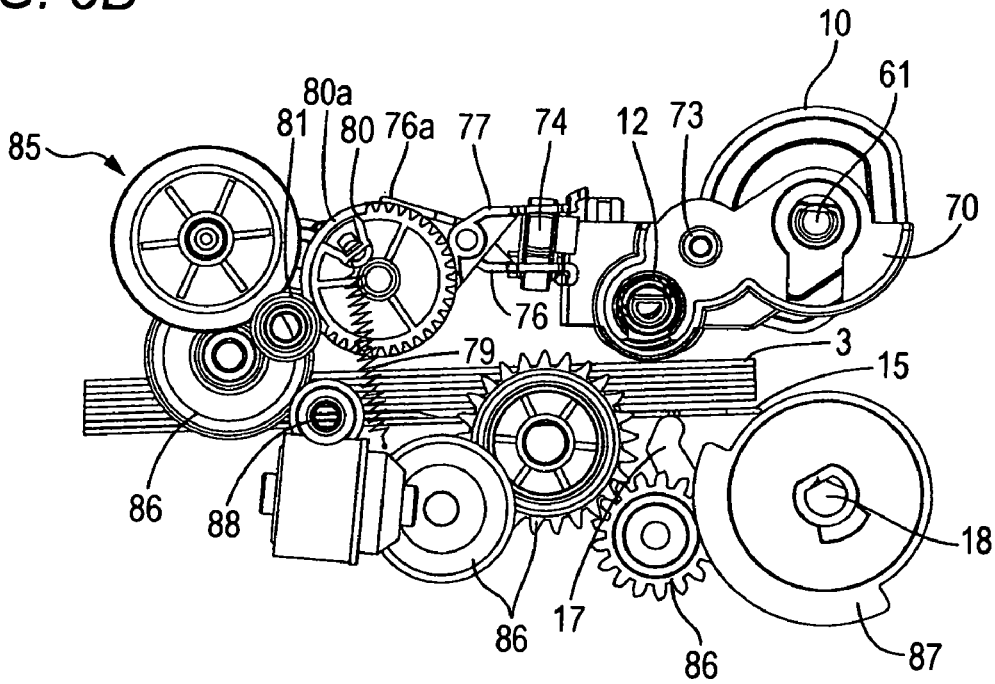

In this embodiment, the configuration is achieved by a relatively simple structure without provision of any detection sensor etc. for detecting the position of the pickup roller 12. Incidentally, FIGS. 3A and 3B are front views of the paper supply roller 10 (showing the front side of the laser printer 1 viewed from the right of FIG. 1). FIGS. 4A and 4B are right views of the paper supply roller 10 (showing the right side of the laser printer 1 viewed from the rear of FIG. 1). FIGS. 5A and 5B are left views of the paper supply roller 10 (showing the left side of the laser printer 1 viewed from the front of FIG. 1).

As shown in FIGS. 3A and 3B, the bearing member 70 is fitted to one end portion of an arm member 74 having a center position 74*a* rotatably supported. When the pickup roller 12 side of the bearing member 70 moves up, the other end portion of the arm member 74 moves down. When the pickup roller 12 side of the bearing member 70 moves down, the other end portion of the arm member 74 moves up.

As shown in FIG. 2, a pair of stopper levers 76 and 77 rotatably provided so as to cross each other on a rotation shaft 75 parallel to the rotation shaft 61 etc. are disposed on the other end portion side of the arm member 74. The other end portion of the arm member 74 is clamped between base end portion sides of the two stopper levers 76 and 77. The most base end portions of the two stopper levers 76 and 77 are linked to each other by a spring member 78 (urging means). As shown in FIGS. 4A and 4B, the front end portion of one stopper lever 76 serves as a stopper portion 76*a* whereas the front end portion of the other stopper lever 77 serves as a stopper portion 77*a*.

Next, a changeover gear 80 for switching on/off the drive of a differential gear 85 (which will be described later) is provided in the rear (the right of FIGS. 4A and 4B) of the stopper levers 76 and 77. As shown in FIG. 2 and FIGS. 5A and 5B, the changeover gear 80 is urged to rotate counterclockwise (clockwise in FIGS. 4A and 4B) by a spring 79. As shown in FIGS. 5A and 5B, there is no tooth in a portion about one third the whole circumference of the changeover gear 80. The changeover gear 80 engages with an input gear 81 to which driving force of a drive motor (not shown) disposed so as to be adjacent to the changeover gear 80 and included in the laser printer 1, so that the changeover gear 80 is rotated. Conversely, when the missing tooth portion 80*a* faces the input gear 81, driving force is not transmitted from the input gear 81 to the changeover gear 80.

As shown in FIGS. 4A and 4B, a stopped portion 82 stopped by the stopper levers 76 and 77 is provided so as to protrude from the right side surface of the changeover gear 80. As shown in FIG. 4A, when the pickup roller 12 is not higher than a predetermined level, the stopper portion 76*a* of the stopper lever 76 is fitted to the stopped portion 82 to thereby position the changeover gear 80 against the urging force of the spring 79. On this occasion, as shown in FIG. 5A, the changeover gear 80 is positioned so that the missing tooth portion 80*a* faces the input gear 81.

On the other hand, when the paper pressing plate 15 becomes higher than a predetermined level, the pickup roller 12 moves up with the increase in the level of the paper pressing plate 15, so that the other end portion of the arm member 74 moves down. As a result, the stopper portion 76*a* of the stopper lever 76 moves up. Accordingly, the positioning of the changeover gear 80 is canceled, so that the changeover gear 80 is forcedly rotated to the position of engagement with the input gear 81 by the urging force of the spring 79. When the changeover gear 80 is driven to rotate again, by the input gear 81, to the position where the missing tooth portion 80*a* faces the input gear 81, the stopper portion 77*a* of the stopper lever 77 is fitted to the stopped portion 82 to thereby position the changeover gear 80 in this position (see FIGS. 4B and 5B).

A clutch lever portion 84 is provided in the rear of the changeover gear 80 (in the right of FIGS. 4A and 4B) so as to be rotatable on a rotation shaft parallel to the rotation shaft 61 etc. The clutch lever portion 84 has an abutment portion 84*a* abutting on the circumferential surface of a cam portion 83 of the changeover gear 80, and an engagement portion 84*b* capable of engaging with a clutch gear 85*b* of a differential gear 85 which will be described later.

The differential gear 85 is disposed in the rear of the clutch lever portion 84. The differential gear 85 has an input gear (not shown), an output gear 85*a* and the clutch gear 85*b* which are provided coaxially. A drive motor (not shown) provided on the device body side of the laser printer 1 gives driving force to the input gear.

As shown in FIG. 4A, when the abutment portion 84*a* of the clutch lever portion 84 is located in the small diameter portion of the changeover gear 80, the engagement portion 84*b* engages with the clutch gear 85*b* so that the driving force given to the input gear of the differential gear 85 is transmitted to the output gear 85*a*. Accordingly, a last stage gear 87 rotating integrally with the lever 17 through the lever shaft 18 is driven through a worm gear 88 and other gears 86 linked to the output gear 85*a*, so that the paper pressing plate 15 is moved up by the lever 17.

On the other hand, as shown in FIG. 4B, when the changeover gear 80 rotates so that the abutment portion 84*a* of the clutch lever portion 84 runs on the large diameter portion of the changeover gear 80, the engagement portion 84*b* disengages from the clutch gear 85*b* to prevent the driving force of the input gear from being transmitted to the output gear 85*a*. As a result, the rotation of the lever 17 is stopped, so that the paper pressing plate 15 stops in this position.

Incidentally, the aforementioned configuration forms a "moving mechanism", a "gear mechanism" and a "changeover member" in this invention.

(2) Operation of the Mechanism for Lifting Up the Paper Pressing Plate

In FIG. 4A, the driving force of the differential gear 85 is transmitted to the lever 17 to lift up the paper pressing plate 15. On this occasion, the driving force of the input gear 81 is not transmitted to the changeover gear 80 (see FIG. 5A). When the surface of the uppermost one of sheets of paper 3 stacked on the paper pressing plate 15 abuts on the pickup roller 12 and further moves up to a certain degree from this state, the other end portion of the arm member 74 is inclined downward (see FIG. 3A) to cancel the stoppage due to the stopper lever 76 to transmit the driving force of the input gear 81 to the changeover gear 80 to rotate the changeover gear 80. Accordingly, as shown in FIG. 4B, the engagement portion 84*b* of the clutch lever portion 84 disengages from the clutch gear 85*b* to prevent the driving force of the input gear of the differential gear 85 from being transmitted to the output gear 85*a*. As a result, the rotation of the lever 17 is stopped, so that the paper pressing plate 15 stops in this position. On this occasion, the changeover gear 80 is stopped by the stopper lever 77 again to prevent the driving force of the input gear 81 from being transmitted to the changeover gear 80 (see FIG. 5B).

Then, sheets of paper 3 are supplied one by one on the basis of execution of the image-forming operation. Hence, the pickup roller 12 moves down (see FIG. 3B). When the other end portion of the arm member 74 moves up to a certain degree in the condition that sheets of paper 3 are further supplied so that the number of sheets of paper reaches a predetermined number (e.g. ten in this embodiment), the stoppage of the changeover gear 80 due to the stopper lever 77 is canceled and the changeover gear 80 is stopped by the stopper lever 76 instead. The changeover gear 80 is driven to rotate so that the engagement portion 84*b* of the clutch lever portion 84 engages with the clutch gear 85*b* again. As a result, the driving force of the differential gear 85 is transmitted to the lever 17 to re-start the lifting of the paper pressing plate 15.

4. Rotating Mechanism for Rotating the Pickup Roller and the Paper Supply Roller (1) Configuration of the Rotating Mechanism As shown in FIG. 2, a drive gear 90 is still provided in the other end portion of the rotation shaft 61 of the paper supply roller 10. The drive gear 90 can engage with an output gear (not shown) to which driving force is given from a drive motor (not shown) on the device body side. The drive gear 90 has a missing tooth portion and is urged to move counterclockwise in FIG. 2 by a spring 91.

Figure 6:
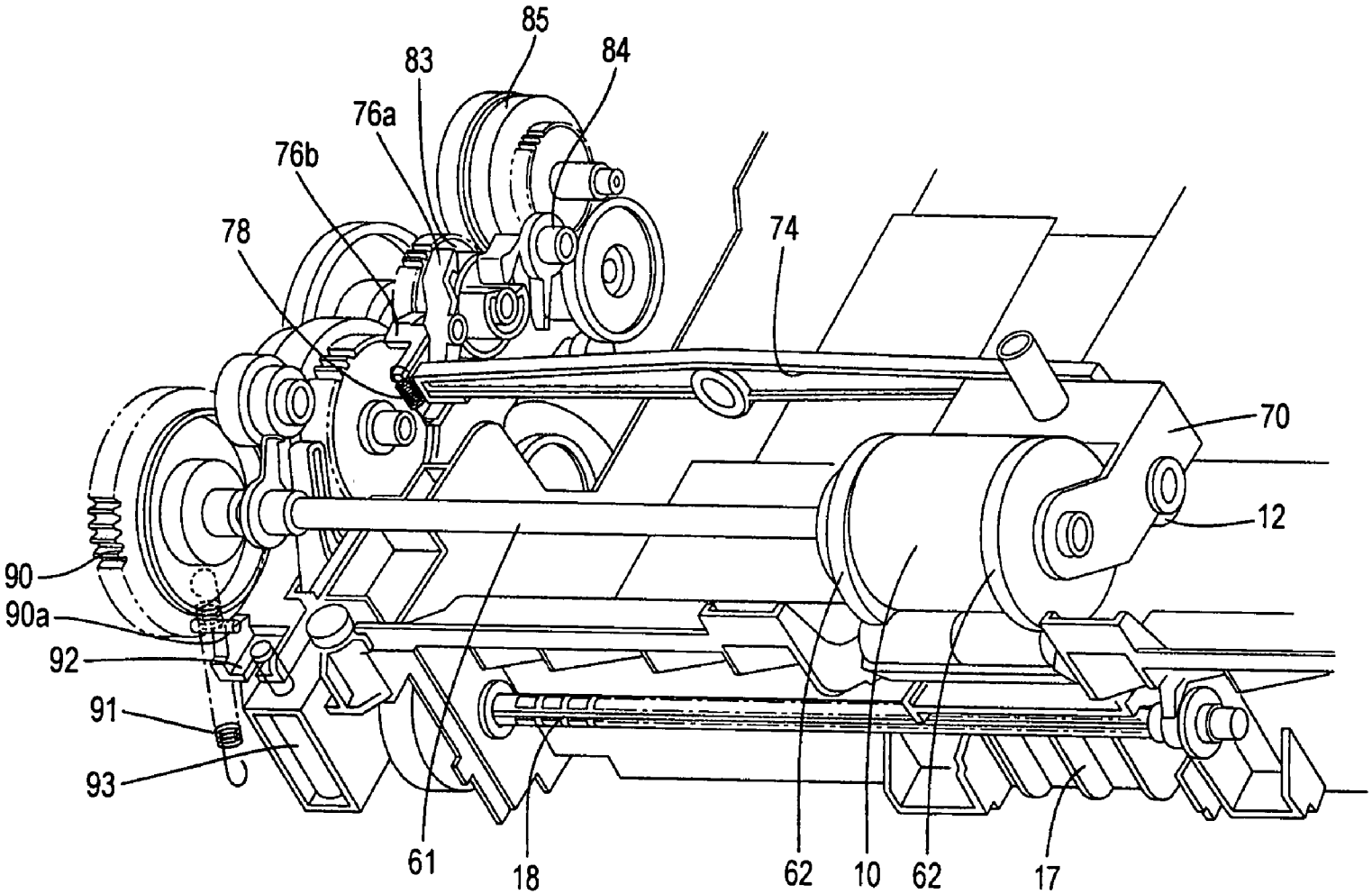
FIG. 6 is a perspective view showing a driving mechanism portion of a paper supply roller.

As shown in FIG. 6, the drive gear 90 has a protrusion portion 90*a*, and a missing tooth portion 90*b* (see FIG. 2). The protrusion portion 90*a* is stopped against the urging force of the spring 91 by a stopper member 92. When the protrusion portion 90*a* is stopped by the stopper member 92, the missing tooth portion 90*b* of the drive gear 90 is positioned so as to be opposite to the output gear. The stopper member 92 is formed so that the stopper member 92 is parted from the drive gear 90 by a solenoid switch 93 as a switching means which turns on when a signal indicating the start of the image-forming operation is received.

According to this configuration, when the signal indicating the start of the image-forming operation is given to the solenoid switch 93, the stoppage of the protrusion portion 90*a* due to the stopper member 92 is canceled temporarily. As a result, the drive gear 90 rotates to the position of engagement with the output gear on the basis of the urging force of the spring 91, so that the paper supply roller 10 substantially makes a rotation. When the missing tooth portion 90*b* comes to the position facing the output gear again, the protrusion portion 90*a* is stopped by the stopper member 92 to prevent the driving force from being transmitted to the paper supply roller 10.

(2) Operation of the Rotating Mechanism

Figure 7A:
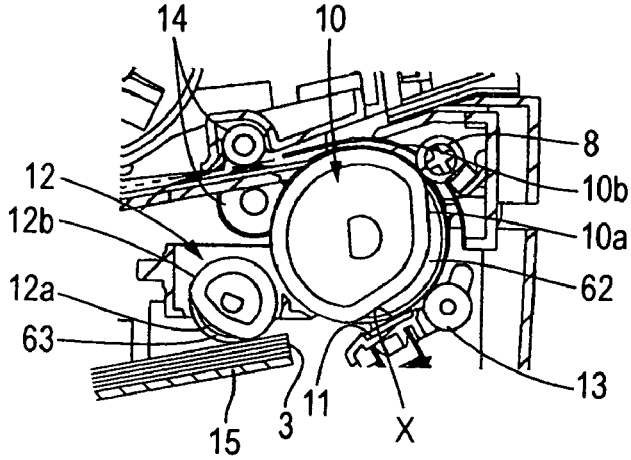
FIGS. 7A to 7C are enlarged views for explaining a state of rotation of the pickup roller and a pickup roller in a paper conveyance process.

First, in an initial state before the start of the image-forming operation, as shown in FIG. 7A, the small diameter portion 12*a* of the pickup roller 12 faces the surface of the uppermost one of sheets of paper 3 stacked on the paper pressing plate 15, so that only the collar portion 63 abuts on the uppermost sheet of paper 3. On the other hand, the small diameter portion 10*a* of the paper supply roller 10 faces the separation pad 11, so that only the collar portion 62 abuts on the separation pad 11.

When the start of the image-forming operation is operated, the solenoid switch 93 turns on so that the stoppage of the protrusion portion 90*a* due to the stopper member 92 is canceled. As a result, the drive gear 90 rotates to the position of engagement with the output gear on the basis of the urging force of the spring 91, so that the paper supply roller 10 begins to rotate counterclockwise in FIG. 7A on the basis of the driving force of the output gear. The pickup roller 12 is driven to rotate by the rotation of the paper supply roller 10. As a result, the large diameter portion 12*b* of the pickup roller 12 abuts on the surface of the uppermost one of sheets of paper 3 stacked on the paper pressing plate 15 and delivers the sheets of paper 3 to the separation position X between the supply roller 10 and the separation pad 11.

Figure 7B:
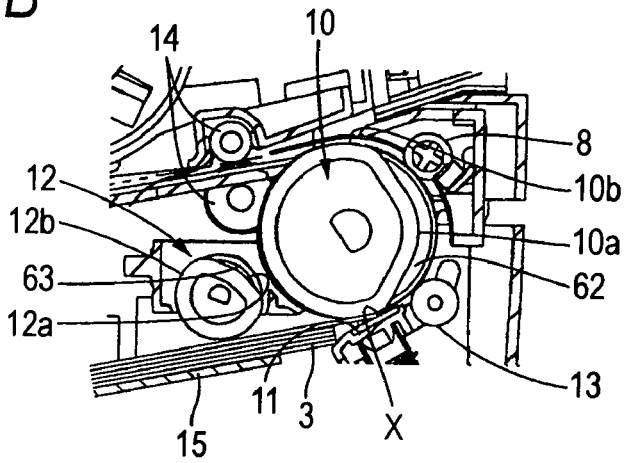

On the other hand, the large diameter portion 10*b* of the paper supply roller 10 also comes into contact with the separation pad 11 to start an operation of separating and feeding the sheets of paper one by one as shown in FIG. 7B. The fed sheet of paper 3 is conveyed along the U-shaped conveyance path while coming into contact with the outer circumferential surface of the paper supply roller 10.

Figure 7C:
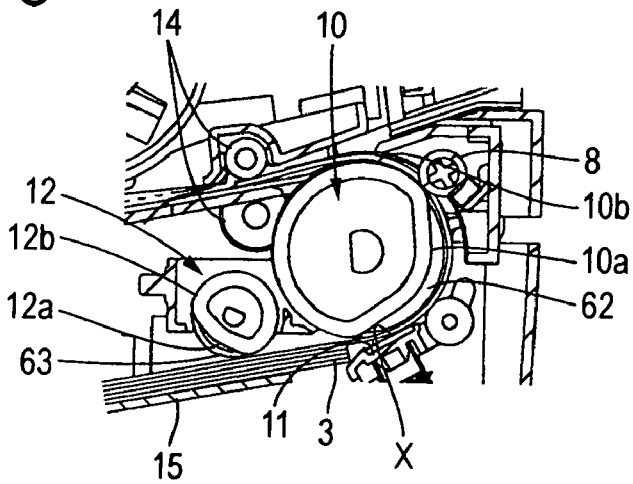

Then, as shown in FIG. 7C, the front end portion of the fed sheet of paper 3 comes to the outlet of the U-shaped conveyance path. The front end portion of the fed sheet of paper 3 is nipped by the registration rollers 14 and conveyed by the registration rollers 14. On this occasion, the missing tooth portion 90*b* of the drive gear 90 faces the output gear, so that the protrusion portion 90*a* is stopped by the stopper member 92 to prevent the driving force from being transmitted to the paper supply roller 10. The pickup roller 12 returns to a state in which the small diameter portion 12*a* of the pickup roller 12 faces the surface of the uppermost sheet of paper 3 on the paper pressing plate 15, so that only the collar portion 63 abuts on the uppermost sheet of paper 3. On the other hand, the paper supply roller 10 also returns to a state in which the small diameter portion 10*a* of the paper supply roller 10 faces the separation pad 11, so that only the collar portion 62 abuts on the separation pad 11. Accordingly, only the collar portions 62 and 63 come into contact with the fed sheet of paper 3, so that the pickup roller 12 and the paper supply roller 10 idle.

5. Paper Supply Tray

Figure 8A:
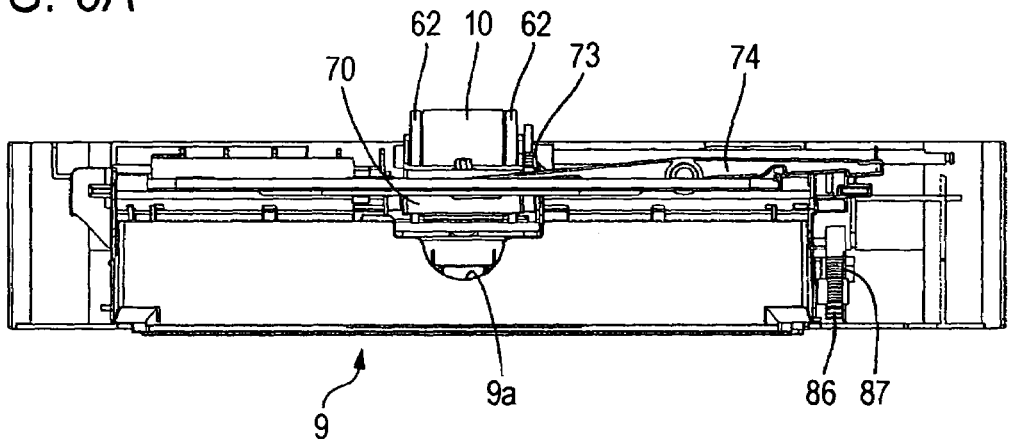
FIGS. 8A to 8C are views showing the shape of a paper supply tray.
Figure 8B:
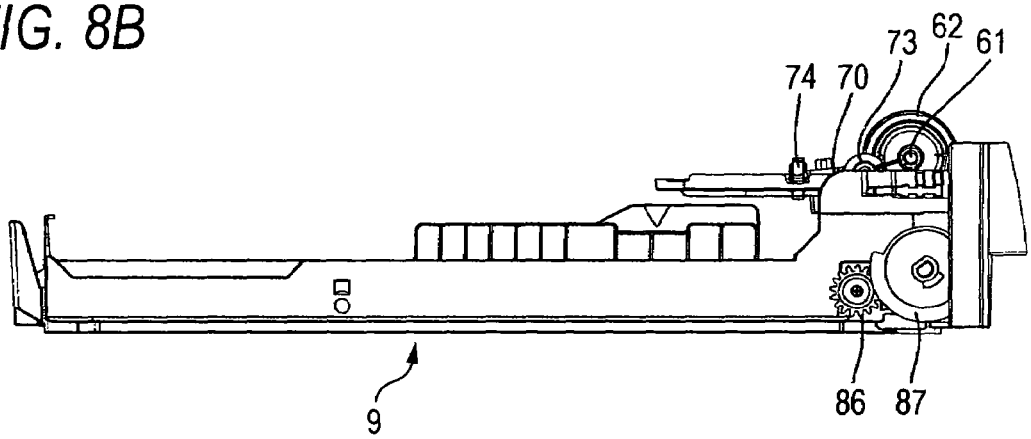
Figure 8C:
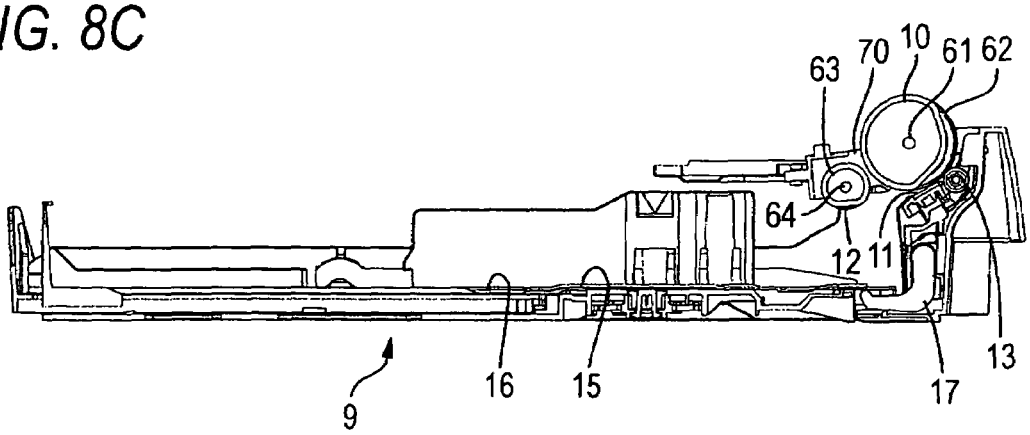

FIGS. 8A to 8C show the shape of the paper supply tray 9. FIG. 8A is a rear view of the paper supply tray 9. FIG. 8B is a left view of the paper supply tray 9. FIG. 8C is a sectional view of the paper supply tray 9 cut in the center position in the left-right direction. Although the bearing member 70 for bearing the pickup roller 12 and the paper supply roller 10, the arm member 74, etc. are shown in FIGS. 8A to 8C, these are provided on the device body side after the paper supply tray 9 is removed from the laser printer 1.

The paper supply tray 9 as a whole is shaped like a box having an opened upper surface. The paper pressing plate 15 is provided as a bottom surface of the paper supply tray 9. The separation pad 11, the pinch roller 13, the lever 17, the last stage gear 87 and the gear 86 engaging with the last stage gear 87 are provided on the front side of the paper supply tray 9 (see FIGS. 8B and 8C).

As shown in FIG. 8A, a concave portion 9*a* is formed as a notch in the upper center of the rear end wall of the paper supply tray 9. When the paper supply tray 9 is attached to the device body, the pickup roller 12 is hung down by its own weight in a space (equivalent to an "attachment/detachment space" in this invention) which is in the inside of the device body and into which the paper supply tray 9 is inserted. In this embodiment, therefore, the concave portion 9*a* is provided in the paper supply tray 9 so that reduction in size of the laser printer 1 in the vertical direction can be achieved while the paper supply tray 9 can be prevented from interfering with the pickup roller 12.

6. Advantages of the Embodiment (1) According to this embodiment, the diameter of the paper supply roller 10 is set to be larger than the diameter of the pickup roller 12. As a result, reduction in device size of the laser printer 1 as a whole can be achieved while the area of contact between the paper supply roller 10 and the separation pad 11 can be taken large sufficiently to keep separability high. Specifically, the height of the laser printer 1 can be reduced because the conveyance path can be inclined downward (or the position of the registration rollers 14 can be moved down) in accordance with reduction in size the pickup roller 12.

(2) The pickup roller 12 is formed so as to be driven to rotate by the paper supply roller 10. Accordingly, the two rollers can be rotated by common driving force to simplify configuration. In addition, synchronization of operations for rotating the two rollers 10 and 12 can be attained easily compared with the configuration in which the two rollers 10 and 12 are driven to rotate by independent driving force.

(3) Configuration is made so that the paper supply roller 10 and the pickup roller 12 do not come into contact with the sheet of paper 3 but only the collar members 62 and 63 come into contact with the sheet of paper 3 to idle the two rollers 10 and 12 in a period of from a state in which the front end of the sheet of paper 3 reaches the nip position of the registration rollers 14 (see FIG. 7C) to a state in which the rear end of the sheet of paper 3 goes out of the separation position X. Accordingly, the conveyance by the registration rollers 14 can be performed smoothly compared with the configuration in which the paper supply roller 10 and the pickup roller 12 are always brought into contact with the sheet of paper 3 in the conveyance process.

Particularly in the configuration in which the paper supply roller 10 and the pickup roller 12 rotate interlockingly as described in this embodiment, it is possible to avoid the situation in which the next sheet of paper 3 may be delivered by the pickup roller 12 though the timing of conveying the next sheet of paper 3 has not come.

(4) Configuration is made so that the positions of the small diameter portions 10*a* and 12*a* of the paper supply roller 10 and the pickup roller 12 at the time of start of an operation of conveying one sheet of paper 3 are the same as those at the time of completion of the conveying operation (see FIGS. 7A and 7C). Accordingly, the sheet of paper 3 can be conveyed smoothly by interlocking of the paper supply roller 10 and the pickup roller 12.

(5) The diameter of the paper supply roller 10 is set to be twice the diameter of the pickup roller 12. That is, when the paper supply roller 10 makes one rotation, the pickup roller 12 makes two rotations. Accordingly, it is easy to synchronize the operations of rotating the two rollers 10 and 12.

(6) In this embodiment, separability and back tension (load resistance at conveyance of a recording medium) are considered so that the pickup roller 12 is brought into contact with the sheet of paper 3 by its own weight while the paper supply roller 10 is brought into contact with the sheet of paper 3 and the separation pad 11 by larger force than that of the pickup roller 12.

(7) Configuration is made so that the sheet of paper 3 delivered by the pickup roller 12 is turned back like a U figure along the outer circumferential surface of the paper supply roller 10 while brought into contact with the outer circumferential surface of the paper supply roller 10. Accordingly, one paper supply roller 10 can be provided as the roller provided on the inner side of the sheet of paper 3 for turning back and conveying the sheet of paper 3. Smooth conveyance and reduction in size and cost of the device as a whole can be attained compared with the case where a plurality of rollers are provided.

(8) In this embodiment, configuration is made so that the operation of the elevating mechanism for bringing the paper pressing plate 15 close to the pickup roller 12 side is switched on and off on the basis of the moving position of the pickup roller 12 displaced in accordance with the quantity of loading of sheets of paper 3. Accordingly, the movement of the paper pressing plate 15 can be controlled by a relatively simple configuration without provision of any detection sensor for detecting the position of the pickup roller 12.

(9) The concave portion 9*a* for avoiding contact with the pickup roller 12 at the time of attachment/detachment is formed in the paper supply tray 9. Accordingly, the paper supply tray 9 can be attached to the device body without damage of the pickup roller 12 at the time of attachment/detachment of the paper supply tray 9.

(10) In this embodiment, the conveying operation of the pickup roller 12 (receiving driving force and driven to rotate to convey the sheet of paper 3) is completed before the rear end of the sheet of paper 3 of the minimum size capable of being stored in the paper supply tray 9 (capable of being subjected to printing by the laser printer 1) passes through the pickup roller 12. Accordingly, the next sheet of paper 3 can be prevented from being delivered when one sheet of paper 3 is conveyed. That is, the drive of the pickup roller 12 and the drive of the paper supply roller 10 are linked to each other so that the pickup roller 12 is rotated by one rotation more than the paper supply roller 10. According to this embodiment, it is possible to solve the problem that the next sheet of paper 3 is conveyed when one sheet of paper 3 is conveyed.

Other Embodiments

The invention is not limited to the embodiment explained based on the description and the drawings. For example, the following embodiments may be included in the technical scope of the invention. Besides the following description, various changes may be made without departing from the gist of the invention.

(1) Although the embodiment has been described on the case where the disk-like collar members 62 and 63 are used as parting member, the invention is not limited thereto. For example, members fixed to positions nearer to the sheet of paper 3 than the small diameter portions 12*a* and 10*a* and farther from the sheet of paper 3 than the large diameter portions 12*b* and 10*b* may be used as long as the members are made of material smaller in conveyance resistance to the sheet of paper 3 than the pickup roller 12 and the paper supply roller 10 and capable of parting the small diameter portions 12*a* and 10*a* of the pickup roller 12 and the paper supply roller 10 from the sheet of paper 3.

(2) Although the embodiment has been described on the case where the pickup roller 12 is driven to rotate by the paper supply roller 10, the invention is not limited thereto. For example, configuration may be made so that the paper supply roller 10 and the pickup roller 12 are driven independently. Incidentally, in accordance with the configuration of the aforementioned embodiment, there is a merit that it is easy to synchronize the rotations of the two rollers 10 and 12.

As described with reference to the embodiments, according to a first aspect of the invention, there is provided a recording medium feeding device including: a delivery roller provided so as to abut on a surface of recording media and for delivering the recording media to a downstream side in a direction of conveyance of the recording media in accordance with the rotation of the delivery roller; a separation member provided on the downstream side with respect of the delivery roller; and a feed roller provided opposite to the separation member to sandwich the recording media delivered by the delivery roller with the separation member, the feed roller rotating for separating and conveying the recording media one by one, wherein a diameter of the feed roller is larger than a diameter of the delivery roller.

The "recording medium feeding device" in this invention may be able to be attached/detached to/from a body of an image forming apparatus (such as a printer, a facsimile machine or a combination machine having a printer function and a scanner function) or may be unable to be attached/detached to/from the body of the image forming apparatus.

The "recording media" may be OHP sheets in place of sheets of paper.

The "conveyance member" may be provided in the recording medium feeding device or may be provided on the apparatus body side of an apparatus (such as an image forming apparatus described above) as a destination of conveyance of the recording media.

The configuration that "the delivery roller and the feed roller are rotated by driving force" mentioned in the embodiments includes a configuration in which the delivery roller and the feed roller are rotated by driving force independently, and a configuration in which driving force is given to one roller so that the other roller is rotated dependently through a connection gear.

The "driving force" mentioned in the embodiments may be driving force given from a drive motor provided in the recording medium feeding device or may be driving force given from a drive motor provided on the apparatus body side of an apparatus (such as an image forming apparatus described above) as a destination of conveyance of the recording media.

When separability of the recording media is taken into account, it is preferable that the area of contact of the feed roller with the recording media is large. On the other hand, when reduction in size of the device is taken into account, it is preferable that the delivery roller is as small as possible. In this configuration, therefore, the diameter of the feed roller is set to be larger than the diameter of the delivery roller so that reduction in size of the device is attained while separability is kept high.

According to the embodiments, one of the delivery roller and the feed roller is driven to rotate so that the other is rotated dependently. Accordingly, the two rollers can be rotated by common driving force, so that configuration can be simplified.

According to the embodiments, the non-circular roller is parted from the recording medium by the parting member lower in conveyance resistance to the recording medium than the non-circular roller, in a period from a state in which the recording medium reaches a position where the recording medium can be conveyed by the conveyance member located on the downstream side of the feed roller in the direction of conveyance to a state in which the recording medium goes out of a position (i.e. separation position) where the feed roller and the separation member face each other. Accordingly, the recording medium can be conveyed smoothly by the conveyance member compared with the configuration in which the delivery roller and the feed roller are always kept into contact with the recording medium. Particularly in the configuration of the paragraph (2), the feed roller brought into contact with the recording medium is rotated by conveyance due to the conveyance member, so that the delivery roller is rotated dependently with the rotation of the feed roller. There is a possibility that the next recording medium will be delivered by the delivery roller though the conveyance timing has not come. According to this configuration, however, the possibility can be prevented.

According to the embodiments, the parting member can be achieved by a relatively simple configuration based on the disk member.

According to the embodiments, the circumferential positions of the small diameter portions around rotation shafts of the delivery roller and the feed roller at the time of start of an operation for conveying one sheet of recording medium are the same as those at the time of completion of the conveying operation. Accordingly, the recording medium can be conveyed smoothly by interlocking of the delivery roller and the feed roller.

According to the embodiments, the delivery roller is formed so that the conveying operation (for driving the delivery roller to rotate in response to driving force to thereby convey the recording medium) is completed before a rear end of the recording medium of a minimum size capable of being fed by the recording medium feeding device (capable of forming an image) passes through the delivery roller. Accordingly, the next recording medium can be prevented from being delivered when one recording medium is conveyed. That is, the drive of the delivery roller and the drive of the feed roller are linked to each other so that the delivery roller is rotated more excessively than the feed roller. According to this configuration, it is however possible to solve the problem that the next recording medium is delivered when one recording medium is conveyed.

When the state in which the large diameter portion and the separation member face each other is started before the timing in which the front end of the recording medium comes to the position where the feed roller and the separation member face each other, the front end of the recording medium hardly goes in between the large diameter portion and the separation member. There is a possibility that the front end of the recording medium will be bent. If the state in which the large diameter portion and the separation member face each other is started after the timing in which the front end of the recording medium comes to the position where the feed roller and the separation member face each other, a plurality of recording media go in between the large diameter portion and the separation member. This causes overlap feeding of two or more recording media. For this reason, it is preferable that the feed roller is rotated just in the timing described in this configuration.

According to the embodiments, the diameter of the feed roller is equal to an integral multiple (twice or more) of the diameter of the delivery roller. That is, when the feed roller makes one rotation, the delivery roller makes rotations of an integral multiple of one. Accordingly, it is easy to synchronize the operations of rotating the two rollers.

When separability and back tension (load resistance at conveyance of the recording medium) are taken into account, it is preferable that the feed roller is brought into contact with the recording medium by force larger than force by which the delivery roller is brought into contact with the recording medium.

According to the embodiments, the recording medium delivered by the delivery roller is turned back like a U figure along the circumferential surface of the feed roller while brought into contact with the circumferential surface of the feed roller. Accordingly, one paper supply roller can be provided as the roller provided on the inner side of the recording medium for turning back and conveying the recording medium. Smooth conveyance and reduction in size and cost of the device as a whole can be attained compared with the case where a plurality of rollers are provided.

The U-shaped path is large in load on conveyance of the recording medium compared with the linear path. Particularly the load on conveyance of a so-called firm recording medium becomes large. Therefore, configuration is made so that the delivery roller and the feed roller are driven to rotate until the recording medium reaches the outlet of the U-shaped path.

According to the embodiments, the moving operation for bringing the loading portion into forced contact with the delivery roller side is switched on and off on the basis of the moving position of the delivery roller displaced by abutting on the recording medium. Accordingly, the movement of the loading portion can be controlled by a relatively simple configuration without provision of any detection sensor etc. for detecting the position of the delivery roller.

According to the embodiments, the advantages based on the respective configurations can be obtained in the image forming apparatus.

According to the embodiments, the notch portion is formed in the recording medium storage portion to avoid contact with the delivery roller when the recording medium storage portion is attached/detached to/from the apparatus body. Accordingly, the recording medium storage portion can be attached to the apparatus body without damage of the delivery roller. In addition, reduction in size of the image forming apparatus can be attained.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A recording medium feeding device comprising:

a delivery roller provided so as to abut on a surface of recording medium and for delivering the recording medium to a downstream side in a direction of conveyance of the recording medium in accordance with the rotation of the delivery roller;

a separation member provided on the downstream side with respect of the delivery roller;

a feed roller provided opposite to the separation member to sandwich the recording medium delivered by the delivery roller with the separation member, the feed roller rotating for separating and conveying the recording medium one by one; and a pair of registration rollers provided on the downstream side with respect to the feed roller, the registration rollers rotating for conveying the recording medium, wherein a diameter of the feed roller is larger than a diameter of the delivery roller, wherein the recording medium delivered by the delivery roller is conveyed so as to be turned back like a U figure along a circumferential surface of the feed roller, a conveyance path for conveying the recording medium after turning back like the U figure is inclined toward a side where a recording medium storage portion is provided, wherein both the delivery roller and the feed roller are provided as a non-circular roller having a large diameter portion, and a small diameter portion that has a diameter smaller than that of the large diameter portion in terms of a sectional shape perpendicular to a rotation axis of the non-circular roller, and wherein the diameter of the feed roller is equal to an integral multiple of the diameter of the delivery roller.

2. The recording medium feeding device according to claim 1, further comprising a connection gear that connects the delivery roller and the feed roller.

3. The recording medium feeding device according to claim 1, wherein the recording medium feeding device further comprises a parting member having lower conveyance resistance to the recording medium than the non-circular roller, the parting member parting the small diameter portion from the recording medium when the small diameter portion faces the recording medium, and wherein the non-circular roller is stopped rotating in a position where the small diameter portion faces the recording medium.

4. The recording medium feeding device according to claim 3, wherein the parting member includes a disk member that is provided coaxially with the non-circular roller so as to be rotatable independent of the non-circular roller, the disk member being formed to have a diameter larger than that of the small diameter portion of the non-circular roller and smaller than that of the large diameter portion of the non-circular roller.

5. The recording medium feeding device according to claim 3, wherein both of the delivery roller and the feed roller are provided as the non-circular rollers connected to each other by a connection gear so that when one of the delivery roller and the feed roller is rotated, the other is rotated dependently through the connection gear, and wherein circumferential positions of the small diameter portions around rotation axes of the delivery roller and the feed roller at a time of start of an operation for conveying one sheet of the recording medium are the same as those at a time of completion of the conveying operation.

6. The recording medium feeding device according to claim 5, wherein the delivery roller completes the conveying operation before a rear end of the recording medium of a minimum size capable of being fed by the recording medium feeding device passes through the delivery roller.

7. The recording medium feeding device according to claim 3, wherein the feed roller is provided as the non-circular roller, and wherein the feed roller is rotated to a position such that the large diameter portion starts facing the separation member when a front end of the recording medium is delivered by the delivery roller.

8. The recording medium feeding device according to claim 1, further comprising a connection gear that connects the delivery roller and the feed roller, wherein the feed roller contacts with the recording medium by force larger than force by which the delivery roller contacts with the recording medium.

9. The recording medium feeding device according to claim 1, wherein a conveyance path extending from the position where the feed roller and the separation member face each other to an image-forming position where an image is formed on the recording medium has a U-shaped path turned back like a U figure so that the delivery roller and the feed roller are rotated by driving force until a front end of the recording medium reaches an outlet of the U-shaped path in an operation for conveying one sheet of the recording medium.

10. The recording medium feeding device according to claim 1, further comprising:

a connection mechanism that connects a rotation axis of the delivery roller and a rotation axis of the feed roller, the connection mechanism being provided so that a side where the delivery roller is attached pivots around a side where the feed roller is attached;

a loading portion located under the delivery roller and provided to stack a plurality of the recording media thereon;

a moving mechanism that moves the loading portion to a side where the delivery roller is provided; and a gear mechanism that transmits driving force to the moving mechanism, wherein the gear mechanism includes a changeover member that switches on and off transmission of the driving force to the moving mechanism on a basis of the moving position of the delivery roller by abutting on the recording media stacked on the loading portion.

11. An image forming apparatus comprising:

a delivery roller provided so as to abut on a surface of recording medium and for delivering the recording medium to a downstream side in a direction of conveyance of the recording medium in accordance with the rotation of the delivery roller;

a separation member provided on the downstream side with respect of the delivery roller;

a feed roller provided opposite to the separation member to sandwich the recording medium delivered by the delivery roller with the separation member, the feed roller rotating for separating and conveying the recording medium one by one;

an image forming section that forms an image on the recording medium conveyed by the feed roller; and a pair of registration rollers provided on the downstream side with respect to the feed roller, the registration rollers rotating for conveying the recording medium, wherein a diameter of the feed roller is larger than a diameter of the delivery roller, wherein the recording medium delivered by the delivery roller is conveyed so as to be turned back like a U figure along a circumferential surface of the feed roller, a conveyance path for conveying the recording medium after turning back like the U figure is inclined toward a side where a recording medium storage portion is provided, wherein the delivery roller and the feed roller are each provided as non-circular rollers, the delivery roller and the feed roller each having a large diameter portion and a small diameter portion that has a diameter smaller than that of the large diameter portion, in terms of a sectional shape perpendicular to a rotation axis of the non-circular rollers, and wherein the diameter of the feed roller is equal to an integral multiple of the diameter of the delivery roller.

12. The image forming apparatus according to claim 11, further comprising:

an apparatus body; and a recording medium storage portion that is detachably attached to the apparatus body and stores the recording media therein, wherein the delivery roller is provided so as to protrude toward an attachment/detachment space of the recording medium storage portion in the apparatus body, and wherein a notch portion is formed in the recording medium storage portion to avoid contact with the delivery roller when the recording medium storage portion is attached/detached to/from the apparatus body.

13. A recording medium feeding device comprising:

a delivery roller provided so as to abut on a surface of recording medium and for delivering the recording medium to a downstream side in a direction of conveyance of the recording medium in accordance with the rotation of the delivery roller;

a separation member provided on the downstream side with respect of the delivery roller;

a feed roller provided opposite to the separation member to sandwich the recording medium delivered by the delivery roller with the separation member, the feed roller rotating for separating and conveying the recording medium one by one; and a pair of registration rollers provided on the downstream side with respect to the feed roller, the registration rollers rotating for conveying the recording medium;

wherein a diameter of the feed roller is larger than a diameter of the delivery roller, wherein both the delivery roller and the feed roller are provided as a non-circular roller having a large diameter portion, and a small diameter portion that has a diameter smaller than that of the large diameter portion in terms of a sectional shape perpendicular to a rotation axis of the non-circular roller, wherein the recording medium feeding device further includes a parting member having lower conveyance resistance to the recording medium than the non-circular roller, the parting member parting the small diameter portion from the recording medium when the small diameter portion faces the recording medium, wherein the non-circular roller is stopped rotating in a position where the small diameter portion faces the recording medium, and wherein the diameter of the feed roller is equal to an integral multiple of the diameter of the delivery roller.

14. The recording medium feeding device according to claim 13, further comprising a connection gear that connects the delivery roller and the feed roller.

15. The recording medium feeding device according to claim 13, wherein the parting member includes a disk member that is provided coaxially with the non-circular roller so as to be rotatable independent of the non-circular roller, the disk member being formed to have a diameter larger than that of the small diameter portion of the non-circular roller and smaller than that of the large diameter portion of the non-circular roller.

16. The recording medium feeding device according to claim 13, wherein both of the delivery roller and the feed roller are provided as the non-circular rollers connected to each other by a connection gear so that when one of the delivery roller and the feed roller is rotated, the other is rotated dependently through the connection gear, and wherein circumferential positions of the small diameter portions around rotation axes of the delivery roller and the feed roller at a time of start of an operation for conveying one sheet of the recording medium are the same as those at a time of completion of the conveying operation.

17. The recording medium feeding device according to claim 16, wherein the delivery roller completes the conveying operation before a rear end of the recording medium of a minimum size capable of being fed by the recording medium feeding device passes through the delivery roller.

18. The recording medium feeding device according to claim 13, wherein the feed roller is rotated to a position such that the large diameter portion starts facing the separation member when a front end of the recording medium is delivered by the delivery roller.

19. The recording medium feeding device according to claim 13, further comprising a connection gear that connects the delivery roller and the feed roller, wherein the feed roller contacts with the recording medium by force larger than force by which the delivery roller contacts with the recording medium.

20. The recording medium feeding device according to claim 13, wherein the recording medium delivered by the delivery roller is conveyed so as to be turned back like a U figure along a circumferential surface of the feed roller.

21. The recording medium feeding device according to claim 13, wherein a conveyance path extending from the position where the feed roller and the separation member face each other to an image-forming position where an image is formed on the recording medium has a U-shaped path turned back like a U figure so that the delivery roller and the feed roller are rotated by driving force until a front end of the recording medium reaches an outlet of the U-shaped path in an operation for conveying one sheet of the recording medium.

22. The recording medium feeding device according to claim 13, further comprising:

a connection mechanism that connects a rotation axis of the delivery roller and a rotation axis of the feed roller, the connection mechanism being provided so that a side where the delivery roller is attached pivots around a side where the feed roller is attached;

a loading portion located under the delivery roller and provided to stack a plurality of the recording media thereon;

a moving mechanism that moves the loading portion to a side where the delivery roller is provided; and a gear mechanism that transmits driving force to the moving mechanism, wherein the gear mechanism includes a changeover member that switches on and off transmission of the driving force to the moving mechanism on a basis of the moving position of the delivery roller by abutting on the recording media stacked on the loading portion.

23. The recording medium feeding device according to claim 1, wherein a point where the registration rollers contact each other is located lower than a highest point where the large diameter portion of the feed roller passes through.

24. The recording medium feeding device according to claim 1, wherein a body casing encloses the delivery roller, the separation member, the feed roller and registration rollers, and wherein a paper supply tray is detachably attached to a bottom portion of the body casing.

* * * * *